United States Patent [19]

Miller et al.

[11] Patent Number: 4,457,097

[45] Date of Patent: Jul. 3, 1984

[54] ACTION TOY AND GAME

[75] Inventors: Ronald L. Miller, Grand Rapids, Mich.; Pierce T. J. Lin, Young Ho, Taiwan

[73] Assignee: Hilco House, Inc., Grand Rapids, Mich.

[21] Appl. No.: 437,368

[22] Filed: Oct. 28, 1982

[51] Int. Cl.[3] ..... A63H 13/02

[52] U.S. Cl. ..... 446/327; 446/334

[58] Field of Search ..... 46/128, 142, 143, 148, 46/154, 145

[56] References Cited

U.S. PATENT DOCUMENTS

| | | | |
|---|---|---|---|
| 1,799,735 | 4/1931 | Crowell | 46/142 |
| 1,853,733 | 4/1932 | Lane | 46/142 |
| 2,269,095 | 1/1942 | Davis | 46/142 |
| 3,130,518 | 4/1964 | Glass et al. | 46/154 |
| 4,244,138 | 1/1981 | Holahan et al. | 46/154 |

FOREIGN PATENT DOCUMENTS

| | | | |
|---|---|---|---|
| 590072 | 6/1925 | France | 46/154 |

*Primary Examiner*—Gene Mancene
*Assistant Examiner*—David I. Tarnoff
*Attorney, Agent, or Firm*—Price, Heneveld, Huizenga & Cooper

[57] ABSTRACT

A puppet toy and game which includes a configured body support having pivotally connected thereto an operable limb assembly in which an upper arm is pivotally connected to the body support, a forearm is pivotally carried on the upper arm, and an activation means activates the upper arm and forearm to extend the limb assembly into a striking position. A return means returns the limb assembly to an at-rest position, with the activation means including a triggering means which is located relative to the body support so as to allow an operator to grasp and carry the body support in one hand while controlling the activation means simultaneously with the same hand. A head is resiliently carried upon the body support to allow the head to return to its original position after being struck, and in toys in which a plurality of limb assemblies are provided the triggering means or levers are located to allow an operator to control the limb assemblies either independently or simultaneously with the same finger or thumb. Preferably at least the forearms are manufactured from a malleable plastic material.

21 Claims, 7 Drawing Figures

ACTION TOY AND GAME

BACKGROUND OF THE INVENTION

Puppets and dolls having a wide variety of opertable features have long been known in the art. Such puppets or dolls find use primarily in the entertainment of children. Quite often children are particularly entertained by puppets or dolls which provide some operative movement which serves to hold the child's attention. Particularly interesting to children are puppets which require little or no instruction and limited manual dexterity to operate, so that the children can themselves control the puppet's actions.

In addition to the desirability of being entertaining to children, it is desirable that a puppet or toy be in-expensive to manufacture, both in its simplicity of design and the minimal requirement of materials used in manufacture. It is often the case that the less complicated a toy the less likely the toy is to break, which is also a desirable function of devices subject to abusive operation. Since such puppets or toys are used primarily by children, however, even relatively simple devices can break. In such situations it is desirable that the toy be of simple design to permit easy repair, preferably by children themselves.

SUMMARY OF THE INVENTION

The toy of the present invention includes a puppet having operable limbs, and a game for use of the same. The puppet toy includes a configured body support that can be grasped by an operator during use of the toy, on which is pivotally carried one or more operable limb assemblies. Each limb assembly includes an upper limb element which is pivotally connected to the body support, an extending limb element pivotally carried on the upper limb element, and an activation means for activating the upper limb element and the extending limb element. The upper limb element and the extending limb element have an at-rest and a striking position, while the activation means includes a triggering means for controlling the activation means, allowing the limb assemblies to operate between the at-rest and striking positions. A return means returns the limb assembly to the at-rest position from the striking position when not activated by the activation means. The triggering means is disposed so as to allow an operator to grasp and carry the body support in one hand while at the same time controlling the activation means with the same hand. In the preferred form the puppet toy includes a head resiliently connected to the body support and extending limb elements manufactured from a malleable plastic material.

The game of the present invention includes the independent operation of a plurality of the above described puppet toys so as to strike the puppet toys of opposing operators.

DETAILED DESCRIPTION OF THE PREFERRED EMBODIMENT

Figure 2:
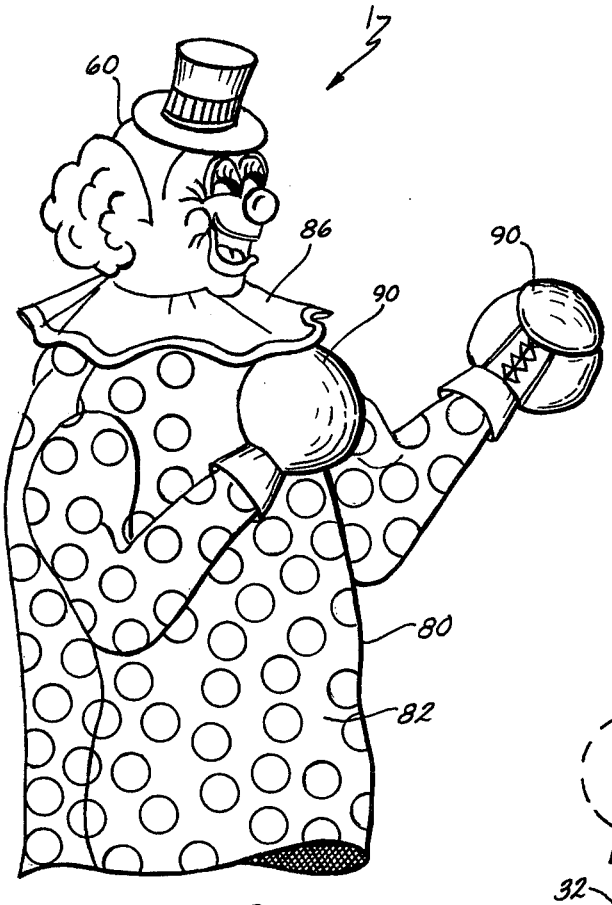
FIG. 2 is a perspective view of a puppet toy in the at-rest position of the present invention.

In the preferred embodiment, the puppet toy 1 of the present invention shown in FIGS. 1–7 includes a configured body support 10 to which is attached a head 60 and limb assemblies 30, the body support and limb assemblies being covered by a garment 80. The free ends of limb assemblies 30 are covered by striking surfaces 90.

Puppet toy 1 is grasped and carried by the body support 10 in one hand of an operator, while the limb assemblies 30 are operated by the same hand of the operator. When activated, limb assemblies 30 extend from an at-rest position shown in FIGS. 2, 3, 4 and 7, to a striking position shown in FIG. 5. This movement replicates the jabbing motion of a boxer from a bent elbow position with arms up in a defensive posture, to an extended straight arm reach. In the game of the present invention a plurality of the above described puppet toys are independently operated so as to strike another puppet toy, shown in FIG. 1.

Figure 5:
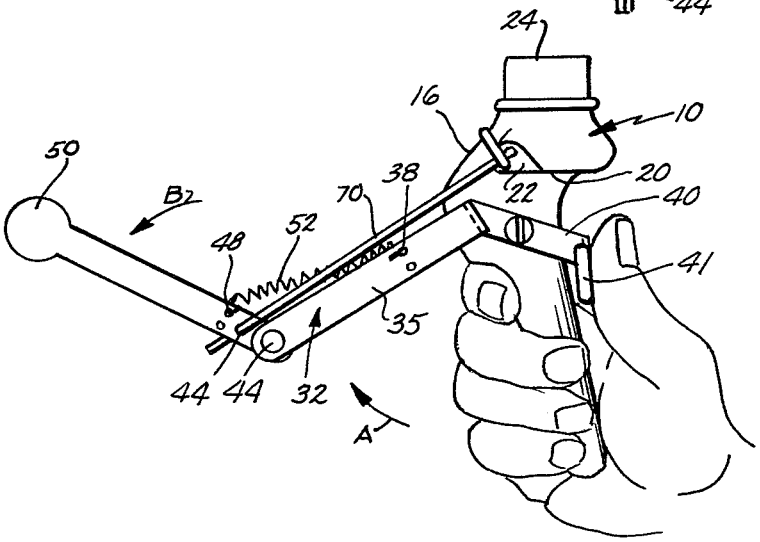
FIG. 5 is a side elevational view of the body support and limb assembly of FIGS. 3 and 4, shown in use in the striking position.

Configured body support 10 has a handle 12 which can be grasped in one hand of an operator, as shown in FIG. 5. Above handle 12 is pivot area 14, shown in FIGS. 3, 4 and 6 having a rectangular configuration, to which is connected limb assemblies 30. The front of pivot area 14 extends forward into a protruding chest area 16, which has an angled forward surface shown in FIGS. 5 and 6. Chest area 16 prevents an operator's hand from sliding up handle 12 during operation of the puppet 1, shown in FIG. 5. Above pivot area 14 are extended shoulders 18, which protrude from opposite sides of body 10. Shoulders 18 have curved upper surfaces 19 and flattened lower surfaces 20. In each extended shoulder 18 is a flattened indented area 22, having an aperture 23 therein. Projecting up from shoulders 18 is a short, cylindrical neck 24.

Figure 3:
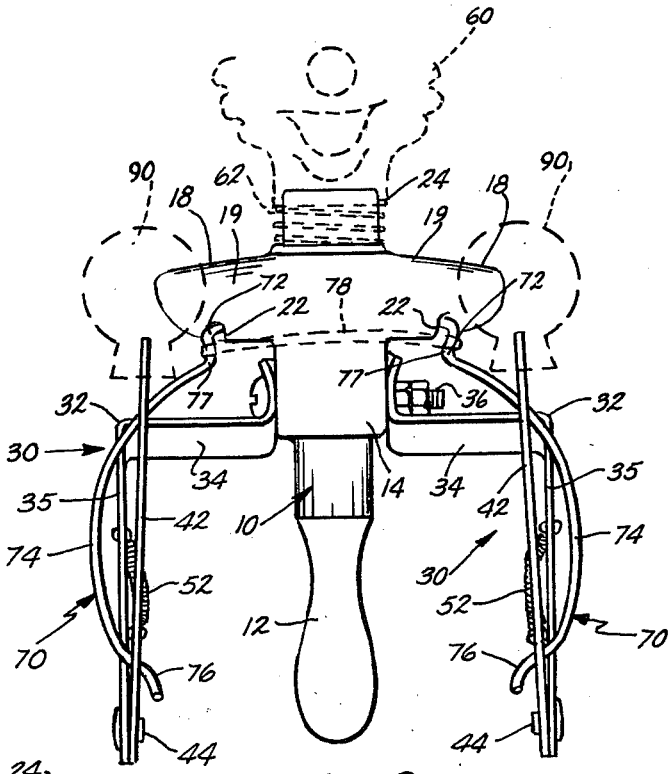
FIG. 3 is a front elevational view of the body support and limb assemblies of the puppet toy shown in FIG. 2 in the at-rest position, with the resiliently mounted head and striking surfaces shown in phantom.
Figure 4:
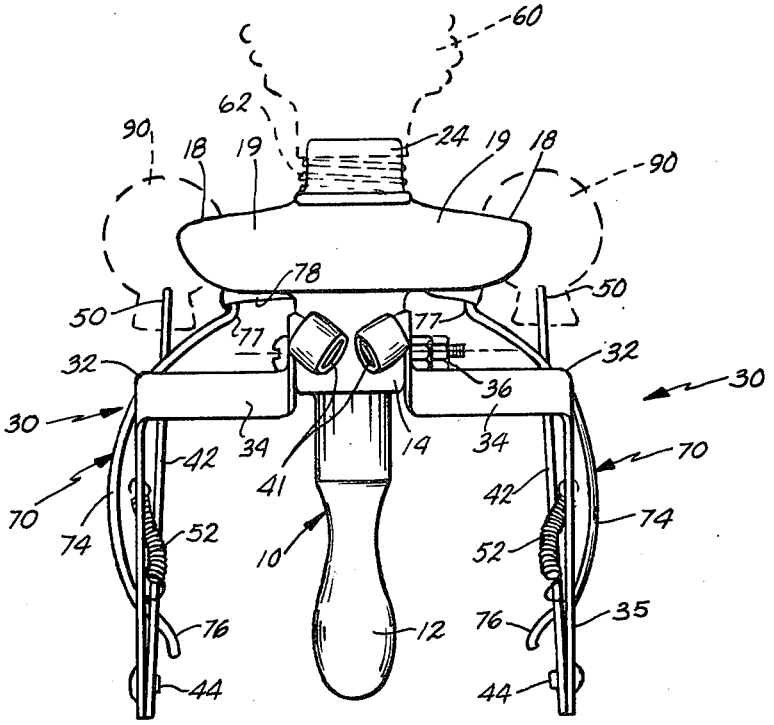
FIG. 4 is a back elevational view of the puppet toy of FIG. 3.
Figure 7:
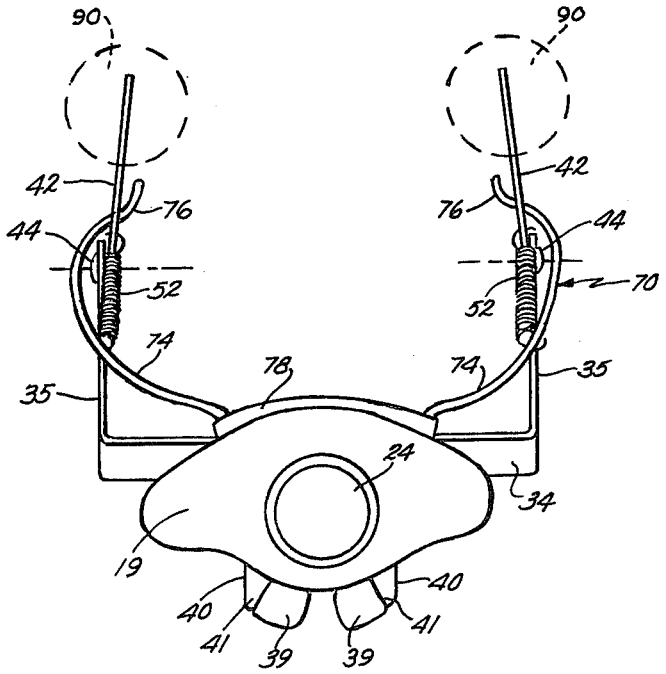
FIG. 7 is a top plan view of the body support and limb assemblies of FIGS. 3 and 4 in the at-rest position, showing the striking surfaces in phantom.

Pivotally connected to body support 10 are two limb assemblies 30, which provide operable arms for puppet 1 as shown in FIGS. 3–7. Each limb assembly 30 includes an upper limb element or upper arm 32 which is bolted to pivot area 14 to form a pivot 36. The majority of upper arm 32 extends forward from body 10 at a downward angle when in the at-rest position. Forward of pivot 36, upper arms 32 have an outward bend 34 extending from the sides of body 10 so as to displace the majority of limb assemblies 30 from the sides of body 10, shown in FIGS. 3, 4, and 7. The forward portion 35 of upper arm 32 is oriented at a slight angle relative to the portion of upper arm 32 through which pivot 36 passes, as shown in FIG. 5. Located in forward portion 35 of upper arm 32 is spring aperture 38. Extending rearward of pivot 36 is lever or trigger 40, trigger 40 being bent over to form tab 41 as shown in FIGS. 4 and 5. Covering tab 41 is a plastic sleeve 39 that provides a smooth surface for contact with the operator's thumb. Tab 41 is located backward of handle 12 a slight distance so as to be comfortably reached by the thumb of a child using the same hand as is grasping handle 12.

Figure 6:
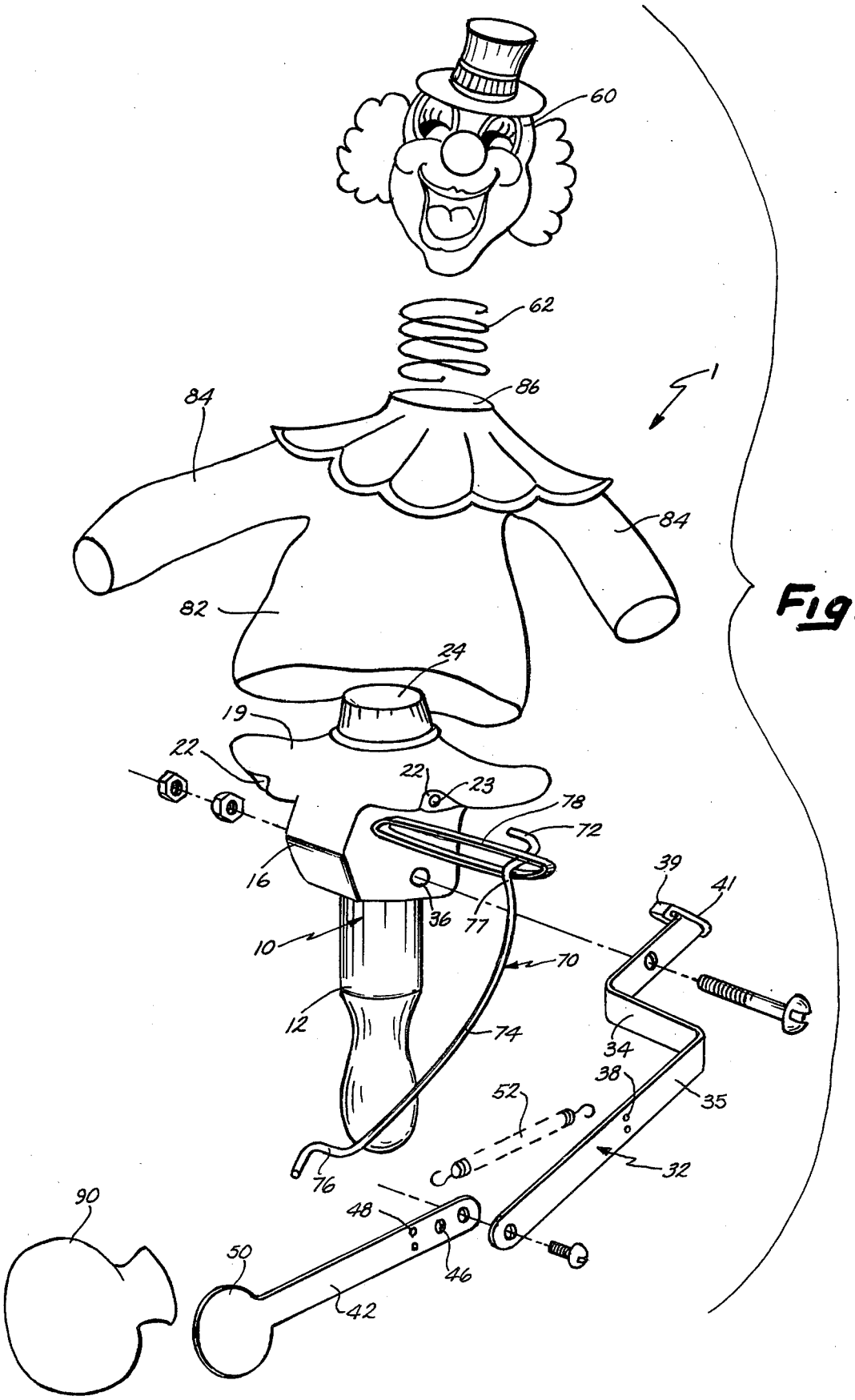
FIG. 6 is an exploded, perspective view of the puppet toy of the present invention having one operable limb assembly.

Extending limb element or forearm 42 is pivotally connected at one end to upper arm 32 by a rivet which forms a pivot 44, FIGS. 5 and 6. Pivot 44 operates as an elbow joining forearm 42 to upper arm 32. While in the at-rest position forearms 42 project generally upward from upper arms 32 as shown in FIGS. 2, 3 and 4. Displaced from pivot 44 toward the free end of forearm 42 is actuating rod aperture 46, shown in FIGS. 5 and 6. Displaced further from pivot 44 and aperture 46 toward the free end of forearm 42 is spring aperture 48. The free end of forearm 42 terminates in an enlarged hand area 50.

Spring 52 is connected to upper arm 32 through spring aperture 48, and to forearm 42 by spring aperture 48. When limb assembly 30 is in the at-rest position, spring 52 is in an untensed or minimally tensed state.

Pivotally connected to body 10 and forearm 42 is actuating rod 70, which operates as an actuating linkage as a portion of the actuating means for limb assembly 30. As best shown in FIGS. 3 and 6, actuating rod 70 has a bent body insert tab 72 at one end which is inserted in hole 23 of indented area 22 on body 10. Rod 70 has a smoothly curved area 74, which curves outward from body 10 allowing the opposite end of rod 70 to mate with actuating rod aperture 46 in forearm 42. Rod 70 terminates in a double bend area 76, which prevents rod 70 from slipping out of aperture 46 when so received. A short distance from tab 72, rod 70 is bent inward to form elastic band seat 77. As shown in phantom in FIG. 3, elastic band 78 is attached to band seats 77 of two limb assemblies 30 to prevent tabs 72 from separating. During assembly, after upper arm 32 and forearm 42 have been attached to body 10, end 76 of rod 70 is inserted into forearm 42 and band 78 is attached to the two actuating rods 70. Rods 70 are then separated sufficiently to allow tabs 72 to be inserted into aperture 23 in indented area 22, and band 78 thereafter prevents tab 72 from sliding out of body 10. Additionally, flattened areas can be pressed into tabs 72 (not shown) to further prevent tab 72 from sliding out of body 10.

A charactured head 60 is resiliently attached to body 10 above neck 24. Head 60 contains an internal cavity in which a neck spring 62 is attached. Spring 62 encircles neck 24 thereby connecting head 60 to body 10. The internal cavity of head 60 is large enough to receive neck 24 and spring 62 therein and allow movement of head 60 about neck 24. Spring 62 displaces head 60 a slight distance above neck 24 sufficiently that head 60 bobs and will be displaced by a slight pressure.

Figure 1:
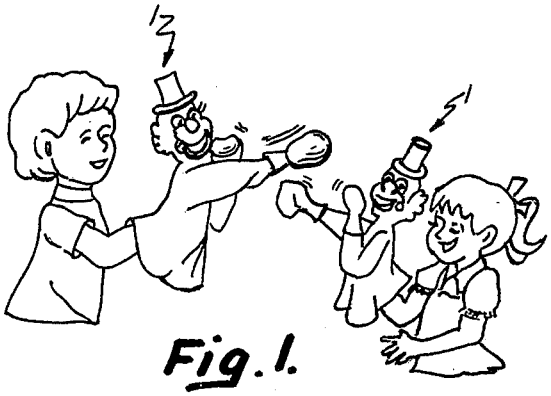
FIG. 1 is a side perspective view of two puppet toys in use in the game of the present invention.

A garmet 80 shown in FIGS. 2 and 6 includes a loose, generally cylindrical body 82 which covers both body support 10 and the hand of an operator during the operation of puppet 1. Garment 80 has an open bottom to allow insertion of the hand of an operator as shown in FIG. 1. Garment 80 also has arms 84 which cover limb assemblies 30, but which allow limb assemblies 30 to operate. Garment 80 has a neck 86 which covers the spring connection of spring 32 to neck 24.

Seated over enlarged hand 50 of forearm 42 and the portions of garment 80 which cover hand 50 is enlarged striking surface or glove 90. Glove 90 has a large, smoothly curved, round shape and is manufactured from molded plastic to reduce the possibility of injury due to the accidental striking of a person with forearm 42.

Upper surfaces 19 and chest 16 of body 10 form a skeleton that shapes garment 80 to retain a torso form, while lower surfaces 20 of shoulders 18 provide a stop means or barrier which prevent upper arm 32 from rotating past the striking position.

In the preferred embodiment body support 10 carries a second limb assembly 30 as described above, with the exception that the various parts are mirrored reversals so that the second limb assembly can be attached to the other side of puppet toy 1.

Preferably, at least forearms 42 are made of malleable plastic material in order to allow forearms 42 to be formed into a desired attitude during use, and which also further reduce the possibility of injury due to accidental striking with forearm 42, particularly in the event of gloves 90 being removed. In manufacture, body 10, head 60 and gloves 90 are all formed of molded plastic so as to be inexpensive and durable. Forearms 42 are riveted to upper arms 32, and springs 52 are connected to forearms 42 and upper arms 32. The two upper arms 32 are bolted to body 10 and actuating rods 70 are connected to body 10 and forearms 42 as described above. Garment 80 is slipped over body 10 and limb assemblies 30, and gloves 90 are slid over enlarged hands 50. Spring 62 is attached to head 60 then slid over neck 24 to connect head 60 to body 10.

In operation, the user grasps handle 12 as shown in FIG. 5 and places his thumb over tabs 41 of trigger 40. Due to the bent configuration of trigger 40 and their location on pivot area 14, triggers 40 are easily operated by the same hand that holds handle 12. Triggers 40 of the two limb assemblies 30 are located sufficiently close together, as shown in FIG. 4, that an operator can depress either trigger independently, or both triggers simultaneously if so desired.

Operation of limb assembly 30 is controlled by trigger 40. As trigger 40 is depressed upper arm 32 pivots about pivot 36 in one direction, designated as A in FIG. 5. Since the distances between pivot 36 and actuating rod insert tabs 72, between pivot 36 and elbow pivot 44, between elbow pivot 44 and actuating rod aperture 46, and along the length of actuating rod 70 each remain constant and form a quadrangle, as upper arm 32 rotates upward in direction A forearm 42 simultaneously pivots in the opposite direction downward, shown as direction B in FIG. 5. This causes enlarged hand 50 to extend forward from body 10 and shifts limb assembly 30 from an at-rest position to a striking position. Upon release of trigger 40 spring 52 urges the portion of forearm 42 containing aperture 58 and portion of upper arm 32 containing aperture 48 together, automatically shifting limb assembly 30 from a striking position to an at-rest position.

In the game of the present invention, two or more puppets 1 are employed. Different operators each operate a puppet 1, attempting to strike the puppet of their opponents. Since the head of puppets 1 are resiliently connected to bodies 10, when the head of a puppet is struck it will bounce and wobble, indicating that it has been so struck.

In light of the above description and drawings it will be seen that various changes or modifications can be made without departing from the spirit of the invention disclosed herein, such as a different number of operable limbs, a more complete body or a fixed head. The above description is merely of the preferred embodiment and the scope of the invention is to be defined by the claims which follow.

The embodiments of the invention in which an exclusive property or privilege is claimed are defined as follows:

1. A hand supported and hand manipulable boxing puppet toy, comprising:

a configured body support;

a handle for supporting the weight of said puppet toy, said handle depending from said body support;

an upper limb element having a first pivot point and a second pivot point, said upper limb element being pivotally carried by said body support at said first pivot point and said upper limb element extending generally forward of said body support;

an extending limb element pivotally carried on said upper limb element at said second pivot point, said extending limb having a free end displaced from said second pivot point;

said upper limb and said extending limb having an at-rest position and a striking position;

activation means for activating said upper limb and said extending limb such that said upper limb pivots about said first pivot point in a first direction of rotation and said extending limb element simultaneously pivots about said second pivot point in a second direction of rotation opposite to said first direction of rotation, so as to extend said free end of said extending limb forward of said body support from said at-rest position to said striking position; and said activation means comprising a first lever extending from said upper limb element, said first lever extending generally rearward of said first pivot point and said first lever being disposed proximate said handle to provide an operator with the ability to grasp said handle and carry said body support in one hand and control said activation means simultaneously with the same hand.

2. A puppet toy as defined in claim 1 further comprising a return means for spring biasing said upper limb and said extending limb to said at-rest position.

3. A puppet toy as defined in claim 1, in which said activation means includes an actuating linkage having a first end pivotally connected to said body support at a third pivot point displaced from said first pivot point, and a second end pivotally connected to said extending limb element at a fourth pivot point displaced from said second pivot point.

4. A puppet toy as defined in claim 3, wherein said upper limb, extending limb, and activation means comprise a first limb assembly, and said puppet toy further comprises a second limb assembly carried on said body support, said second limb assembly disposed so as to allow an operator to grasp and carry said body support in one hand while controlling said first and second limb assemblies with the same hand.

5. A puppet toy as defined in claim 4, further comprising:

a head;

resilient connecting means for connecting said head to said body support, to provide said head with the ability to be displaced relative to said body and return said head to its predisplaced position.

6. A puppet toy as defined in claim 5, in which said resilient connecting means comprises a coil spring.

7. A puppet toy as defined in claim 5 in which said extending limbs are made of a malleable plastic material.

8. A puppet toy as defined in claim 3, wherein said return means comprises a tension spring connected to said upper limb and to said extending limb.

9. A puppet toy as defined in claim 1, further comprising:

a head;

resilient connecting means for connecting said head to said body support, to provide said head with the ability to be displaced relative to said body and return said head to its predisplaced position.

10. A puppet toy as defined in claim 9 in which said resilient connecting means comprises a coil spring.

11. A puppet toy as defined in claim 1 in which said extending limbs are made of a malleable plastic material.

12. A hand supported and hand manipulable boxing puppet toy, comprising:

a configured body support;

an upper limb element having a first pivot point and a second pivot point, said upper limb element being pivotally carried by said body support at said first pivot point to extend generally forward of said body support;

an extending limb element pivotally carried on said upper limb element at said second pivot point, said extending limb having a free end displaced from said second pivot point;

said upper limb and said extending limb having an at-rest position and a striking position;

activation means for activating said upper limb and said extending limb such that said upper limb pivots about said first pivot point in a first direction of rotation and said extending limb element simultaneously pivots about said second pivot point in a second direction of rotation opposite to said first direction of rotation, so as to extend said free end of said extending limb forward of said body support from said at-rest position to said striking position;

said activation means comprising a first lever depending from said upper limb element and extending generally rearward of said first pivot point, said first lever being disposed proximate said body support to provide an operator with the ability to grasp and carry said body support in one hand and control said activation means simultaneously with the same hand;

said upper limb, extending limb, activation means and first lever comprising a first limb assembly; and a second limb assembly carried on said body support, said second limb assembly including a second lever disposed proximate said body support to provide an operator with the ability to grasp and carry said body support in one hand and control both of said first and said second limb assemblies with the same hand, said first and said second levers being disposed relative to each other such that an operator is provided with the ability to operate both said first lever and said second lever independently in one case and simultaneously in another case with the same digit.

13. A puppet toy as defined in claim 12, further comprising stop means for preventing extension of said limb assemblies past said striking position.

14. A puppet toy as defined in claim 13 in which said body support includes a handle and shoulder portions, said shoulder portions being shaped to support a garment which conceals said body support, said stop means comprising a surface disposed on said shoulder portions which prevents rotation of said upper limb beyond a maximum point of rotation.

15. A puppet toy as defined in claim 12, further comprising a means for biasing said upper limb and said extending limb to said at-rest position, said biasing means being connected to said upper limb and to said extending limb.

16. A hand portable and hand manipulable boxing puppet toy comprising:

a configured body support including a handle and extending shoulder portions, said shoulder portions shaped to support a garment which conceals said handle and said handle supporting the weight of said puppet toy;

an upper arm having a first pivot point and a second pivot point, said upper arm being pivotally carried on said body support at said first pivot point;

a forearm pivotally carried on said upper arm at said second pivot point, said forearm having a free end displaced from said second pivot point;

said upper arm and said forearm having an at-rest position and a striking position, an actuating rod pivotally connected to said body support at a third pivot point displaced from said first pivot point, said actuating rod being pivotally connected to said forearm at a fourth pivot point displaced from said second pivot point;

a first lever connected to said upper arm and disposed relative to said body support handle portion to provide an operator with the ability to grasp, support and carry said handle portion of said body support in one hand and depress said first lever with the same hand;

means for resiliently biasing said upper arm and said forearm from said striking position to said at-rest position by pivoting said forearm toward said upper arm about said second pivot point and also translating said forearm by pivoting said upper arm about said first pivot point, said resilient biasing means secured to and extending between said upper arm and said forearm.

17. A puppet toy as defined in claim 16 further comprising:

a head;

a spring resiliently connecting said head to said body support.

18. A puppet toy as defined in claim 16, in which said upper arm, said forearm, said actuating rod, said first lever, and said return means comprise a first limb assembly;

further comprising a second limb assembly pivotally connected to said body support;

said second limb assembly including a second lever disposed relative to said first lever such that an operator is provided with the ability to operate both said first lever and said second lever independently in one case and simultaneously in another case with the same digit.

19. A puppet toy as defined in claim 15, in which at least said forearms are formed from a malleable plastic material.

20. A hand portable and hand manipulable boxing puppet toy comprising:

a configured body support including a handle and extending shoulder portions, said shoulder portions shaped to support a garment which conceals said handle and said handle supporting the weight of said puppet toy;

an upper arm having a first pivot point and a second pivot point, said upper arm being pivotally carried on said body support at said first pivot point to extend generally forward thereof;

a forearm pivotally carried on said upper arm at said second pivot point, said forearm having a free end displaced from said second pivot point;

said upper arm and said forearm having an at-rest position and a striking position;

an actuating rod pivotally connected to said body support at a third pivot point displaced from said first pivot point, said actuating rod being pivotally connected to said forearm at a fourth pivot point displaced from said second pivot point;

a lever extending from said upper arm, said lever extending generally rearward of said first pivot point and said first lever being disposed proximate said handle to provide an operator with the ability to grasp, support and carry said handle in one hand and depress said lever with the same hand to shift said upper arm and forearm from said at-rest position to said striking position.

21. A puppet toy as defined in claims 1, 2, 3, 4, 12, 13, 8, 14, 9, 10, 11, 5, 6, 7, 16, 17, 18, 19, 20 or 15: wherein a plurality of said puppet toys are provided for independent operation by a plurality of participants to strike the puppet toy of opposing participants and thus define a competitive game.

* * * * *